US005774148A

United States Patent [19]

Cornell et al.

[11] Patent Number: 5,774,148

[45] Date of Patent: Jun. 30, 1998

[54] PRINTHEAD WITH FIELD OXIDE AS THERMAL BARRIER IN CHIP

[75] Inventors: Robert Wilson Cornell; Lawrence Russell Steward, both of Lexington, Ky.

[73] Assignee: Lexmark International, Inc., Lexington, Ky.

[21] Appl. No.: 545,126

[22] Filed: Oct. 19, 1995

[51] Int. Cl.[6] ..... B41J 2/05

[52] U.S. Cl. ..... 347/59; 347/63

[58] Field of Search ..... 347/590, 62, 63

[56] References Cited

U.S. PATENT DOCUMENTS

| | | | |
|---|---|---|---|
| 5,055,859 | 10/1991 | Wakabayashi et al. | 347/59 |
| 5,081,473 | 1/1992 | Hawkins et al. | 347/59 |
| 5,122,812 | 6/1992 | Hess et al. | 346/1.1 |
| 5,159,353 | 10/1992 | Fasen et al. | 346/140 R |
| 5,322,811 | 6/1994 | Komuro et al. | 347/59 |
| 5,376,231 | 12/1994 | Matsumoto et al. | 347/59 |
| 5,469,200 | 11/1995 | Terai | 347/63 |
| 5,479,197 | 12/1995 | Fujiwara et al. | 347/63 |
| 5,517,224 | 5/1996 | Kaizu et al. | 347/59 |
| 5,534,069 | 7/1996 | Kuwabara et al. | 347/59 |
| 5,635,966 | 6/1997 | Keefe et al. | 347/59 |
| 5,639,386 | 6/1997 | Burke et al. | 347/62 |

FOREIGN PATENT DOCUMENTS

| | | | |
|---|---|---|---|
| 0 518 467 A2 | 12/1992 | European Pat. Off. | B41J 2/16 |
| 0 641 658 A2 | 3/1995 | European Pat. Off. | B41J 2/16 |
| 0 661 162 a2 | 7/1995 | European Pat. Off. | B41J 2/195 |

*Primary Examiner*—Jeffrey L. Sterrett
*Attorney, Agent, or Firm*—John A. Brady

[57] ABSTRACT

In an active ink jet printhead chip (13) a layer of boron-phosphorus doped silicate glass (BPSG) immediately underneath the heaters followed by a silicon dioxide layer. This insulates the substrate during the fire pulse of its heater, yet allows thermal energy to diffuse into the silicon during the time between firing pulses.

10 Claims, 6 Drawing Sheets

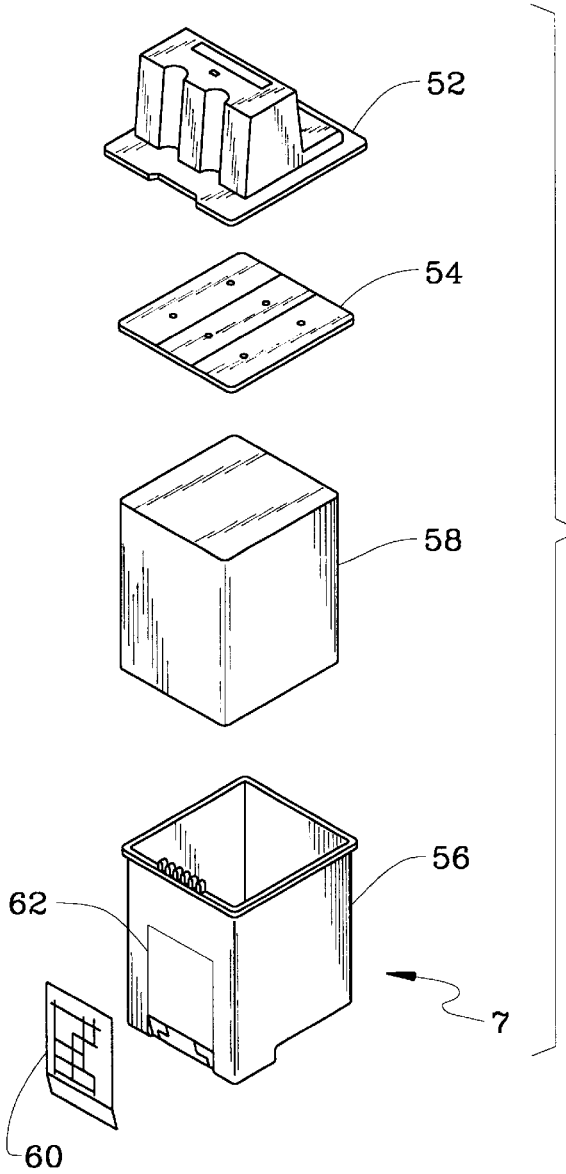
FIG. 6
FIG. 7
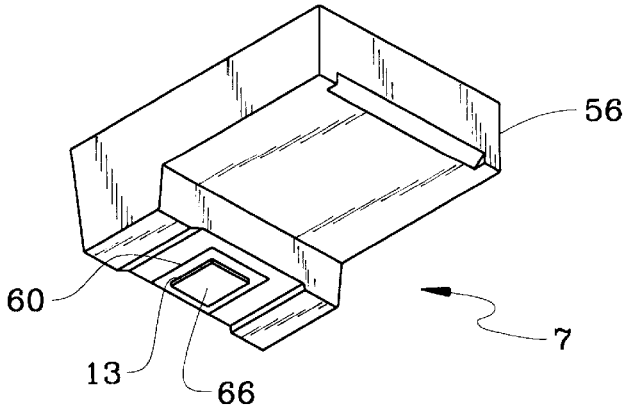

PRINTHEAD WITH FIELD OXIDE AS THERMAL BARRIER IN CHIP

TECHNICAL FIELD

This invention relates to ink jet printheads which expel ink drops from a nozzle by vaporizing ink in a chamber with heat produced by a semiconductive chip. The chip has heating elements for a large number of nozzles.

BACKGROUND OF THE INVENTION

The first phase of printing, in thermal ink jet technology, is to pass current through a resistive element. The resistive element is commonly referred to as a heater. To pass current through the heater, an electrically conductive path must exist between the power supply and the ground plane. Also, in this electrically conductive path, there must exist a means of switching the current on and off. Transistors are commonly used in such circuits to function as the switching devices.

Early ink jet printheads had limited numbers of heaters (64 or less). The current flow path for such designs is explained with the aid of FIG. 1. The heaters 1 are directly connected to the power supply 3 by a network of cables 5 from power supply 3 to contacts 6 of a printhead 9, then through individual wire leads 11 to a semiconductor chip 13 incorporating the heaters 1.

The transistors 15 which function as on-off switches for heaters 1 are connected through contacts 17 on printhead 9. Transistors 15 are connected to the circuit ground. Under computer or applications specific integrated circuits control (ASIC), a fire pulse 19 is applied to one or more of transistors 15, allowing currents to control through the heater 1 to which that transistor is connected.

Also it is typical in designs of this type to group the high voltage potential side of the heaters together in groups, such as groups of twelve, as indicated for one group by the dotted outline 20. The other leads 11 which each lead to a different group of heaters 1 such as group 20 shown. The groups 20 allow multiple heaters 1 to be connected to power supply 3 by a single connection. However, each ground connection from each transistor 15 must be made separately, so that each transistor 15 can control a single heater 1.

This circuit design is simple and effective, but it is limited to low heater count printhead designs because it is an inefficient use of chip contacts, such as contacts 6 and 17. For example, if a chip has forty-eight heaters, it is common to group them into four groups of twelve. Then counting the four high side connections 6 and the forty-eight ground side connections 17, at least fifty-two connections must be made on chip 13. Existing typical ink jet designs of this type have enough space on the periphery of the chip to make these connections.

As technology advances, the number of heaters on each chip increases. But the cost of processed silicon is a first order function of chip area. So to minimize cost, the size of the chip should not increase in proportion to the increase in heater numbers. This means the chip periphery no longer has the space available to make all of the necessary connections with the circuit design typified in FIG. 1. As heater numbers increase to one hundred, two hundred, and more, it is clear that a different connection scheme is called for.

The connection scheme used in later print head designs is commonly referred to as multiplexing. It is not new to the electronics industry to multiplex signals to reduce connections; rather it is commonplace. The multiplexing scheme can be described with the aid of FIG. 2. In the figure only the current flow path on the chip is shown. The circuit on the chip comprises heaters 1, power bus lines 21, address lines 23 and metal oxide semiconductor field effect transistors (MOSFET's) 25. The MOSFET 25 gates are connected to the address lines 23. The source side of the MOSFET's 25 are connected to the ground plane. The drain side of each MOSFET 25 is connected to one side of the heaters 1. The other side of each of the heaters 1 is connected to a power bus line 21.

To cause a current flow in a heater 1, an address line 21 connected to the heater 1 is brought to a voltage potential sufficient to enable the MOSFET 25 connected to the heater 1. This is typically above the threshold voltage of MOSFET 25, but below the gate breakdown voltage of MOSFET 25. However, no current flows through the heater until the power bus line 21 is switched on. While the MOSFET 25 is in the enabled state, a voltage potential is applied to the power bus line 21. During the period when both the gate voltage and the power bus voltage are held high, current will flow through the heater 1. Each address line 23 connects to a group of transistors 25, and each transistor 25 in the group is connected to only one of the power bus lines 21 through a heater 1. Clock control signals for both the address lines 23 and the power control lines 21 are generated in the printer (not shown). The power bus lines 21 are switched on and off by drive transistors in the printer (not shown), one for each power bus line 21, under control by an ASIC in the printer. The MOSFET 25 gates are enabled every clock cycle, but the power bus lines 21 are only turned on in response to a print command, i.e. to fire a particular heater 1. The timing of this control is shown in the lower left of FIG. 2.

The advantage of multiplexing in reducing contacts count is explained by the following example. Consider the circuit shown in FIG. 2. This chip has 104 heaters. The high side heater connections are made by eight power bus lines 21. Each power bus line consists of thirteen heaters per group. Also, since there are thirteen heaters per group, there must be thirteen address line connections. Summing the connections which must be made at the chip periphery, there are eight power bus lines 21, eight ground bus lines (not shown) to power lines 21, and thirteen address lines, for a total of twenty-nine connections. Multiplexing allows one hundred four heaters to be connected to the printer electronics with just twenty-nine connections. This is a vast improvement over a circuit of the style shown in FIG. 1, which would require eight power bus connections and one hundred four ground side connections, or one hundred twelve total, to connect the heaters to the printer. This number would be prohibitive because of the effect it would have on increasing the chip size to provide a long enough periphery for the many connections.

The other component shown in FIG. 2 is a pulldown resistor 27 connected to each address line. The purpose of this component is to ensure the MOSFET 25 gate is at a known (ground) potential when the is no clock signal present.

The reduction of contacts in a multiplexing drive circuit does not come for free. The chips described in the circuit of FIG. 1 were completely passive. With a multiplexing scheme, active devices must be incorporated in the heater chip. The active devices used in this invention are N-channel metal oxide semiconductor field effect transistors, which are now well known in the electronics industry. Simply stated, a field effect transistor consists of a source, a drain, and a gate. The source and drain are doped silicon regions.

They are separated by a channel. Directly opposite the channel is a gate. When a voltage potential is applied to the gate, it creates an electric field in the immediate vicinity. Depending on the polarity of the device, this field will either attract electrons to the channel region (enhancement mode) or repel them (depletion mode). If a voltage potential exists between the source and the drain while the gate is held above some threshold voltage, current will flow through the device. A channel MOSFET is an interleaved assembly of such elements forming one MOSFET suitable for carrying high current.

During a typical fire pulse of the heater, the heater region is exposed to a power density of the order of $10^9$ watts/meter squared. This power density greatly exceeds that of the surface of the sun. As a result, the temperature of the active heater slews at a rate exceeding $10^6$ degrees C. per second. The rapid heating of the ink causes explosive boiling, called nucleation. Since nucleation occurs at or near the superheat limit of the ink, the resulting vapor bubble begins to grow with an initial pressure impulse greater than 100 atmospheres. The pressure pulse imparts momentum to the fluid ink. Within several microseconds after nucleation, the vapor pressure inside the bubble is less than 1 atmosphere. The end effect is a short duration vapor bubble that displaces ink inside the firing chamber, resulting in a small droplet of ink being jetted from a nozzle located above the active heater.

Each heater is an element on a silicon semiconductor chip. During the fire pulse, it is desired that the heat flux flow into the ink, not the silicon substrate of the chip. Conversely, in the time between the end of the first pulse and the start of the next cycle, it is desired to have the residual thermal energy diffuse into the silicon to dissipate the heat. In this operation the thermal barrier should only act as an insulator for a very short period of time (a few microseconds). After the first pulse ends, it is desired to have the heat flux flow into the silicon. The time scale for the cooling event is on the order of 100 microseconds. These opposing goals are accomplished by a judiciously sized thermal barrier that is physically located between the heater element and the silicon substrate.

Thermally grown $SiO_2$ is commonly used as the thermal barrier in ink jet chips. For example, finite element modeling shows that pulse widths 3.4 microseconds long requires an $SiO_2$ thermal barrier that is 1.65 microns thick. The effectiveness of this prior art is found in various commercial printheads.

For the reasons described earlier, printheads with high numbers of heaters have MOSFET's integrated into the chip. The integration of such active devices introduces new materials into the chip fabrication process from semiconductor wafers. One of these additional materials is boron-phosphorous doped silicate glass (BPSG). It is used to form the field oxide of N-MOSFET devices. The heater material may be hafnium diboride (HfB2) or tantalum aluminum (TaAL), which, in accordance with this invention, is located directly on the BPSG, not on $SiO_2$ as in the prior art. U.S. Pat. Nos. 5,159,353 to Fasen et al and 5,122,812 to Hess et al illustrative such printheads and chips generally, but not employing BPSG.

A primary concern of the such use of BPSG is stress failure. In reaching this invention resistance to stress of BPSG was first predicted theoretically using a formula known in the prior art relating stress to elastic energy to predict failure for thin films as follows: Elastic Energy equals Stress squared times Film Thickness times the quantity 1 minus Poisson's Ratio, the entire product divided by Young's Modulus. These theoretical computations indicated probable success in using BPSG, and the invention was then verified by actual implementations.

The most important property of the thermal barrier during use is its thermal conductivity. The well known Lorentz number relates a material's thermal conductivity and it electrical conductivity. Since BPSG is a semiconductor and $SiO_2$ is an insulator, it was expected that BPSG would be slightly more thermally conductive than $SiO_2$. From this it was determined theoretically and then by actual implementations that a barrier of first a BPSG layer and then an $SiO_2$ layer the same thickness as the BPSG layer adequately perform the function of the thermal barrier.

DISCLOSURE OF THE INVENTION

This invention provides a BPSG material immediately underneath the heaters on the chip followed immediately by an insulator layer of $SiO_2$. The combined thickness of the BPSG layer and the $SiO_2$ layer is sized such that it insulates the substrate during the fire pulse of its heater, yet allows thermal energy to diffuse into the silicon during the time between the end of the pulse and the start of the next cycle. More specifically the BPSG layer is on a $SiO_2$ layer, each approximately of the same thickness.

BRIEF DESCRIPTION OF THE DRAWING

The details of this invention will be described in connection with the accompanying drawing, in which FIG. 6 illustrates an ink jet printhead employing the chip; and FIG. 7 is a bottom view in perspective of the printhead of FIG. 6.

BEST MODE FOR CARRYING OUT THE INVENTION

Figure 1:
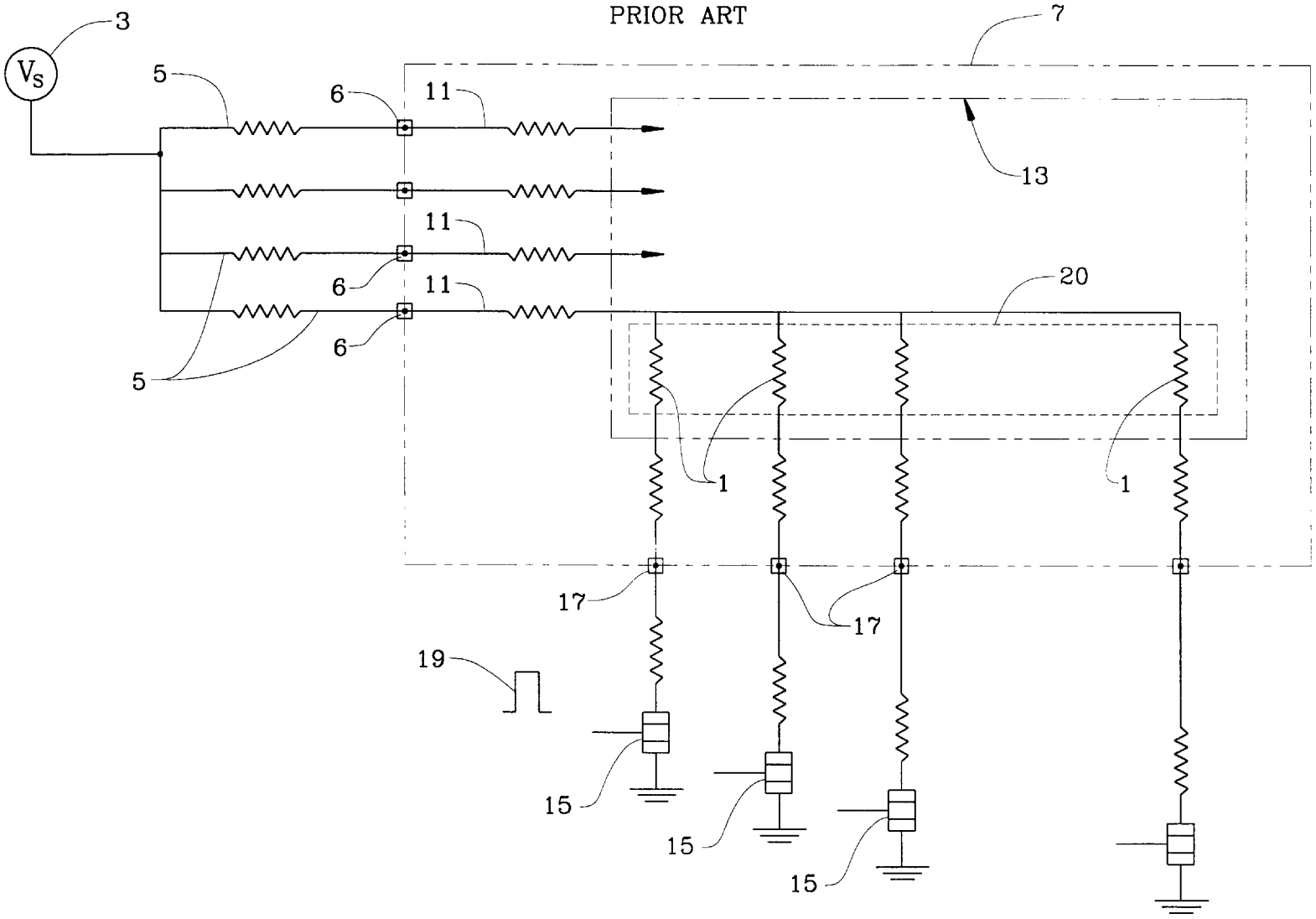
FIG. 1 PRIOR ART
FIG. 1 illustrates prior art printheads having relatively few heaters.
Figure 2:
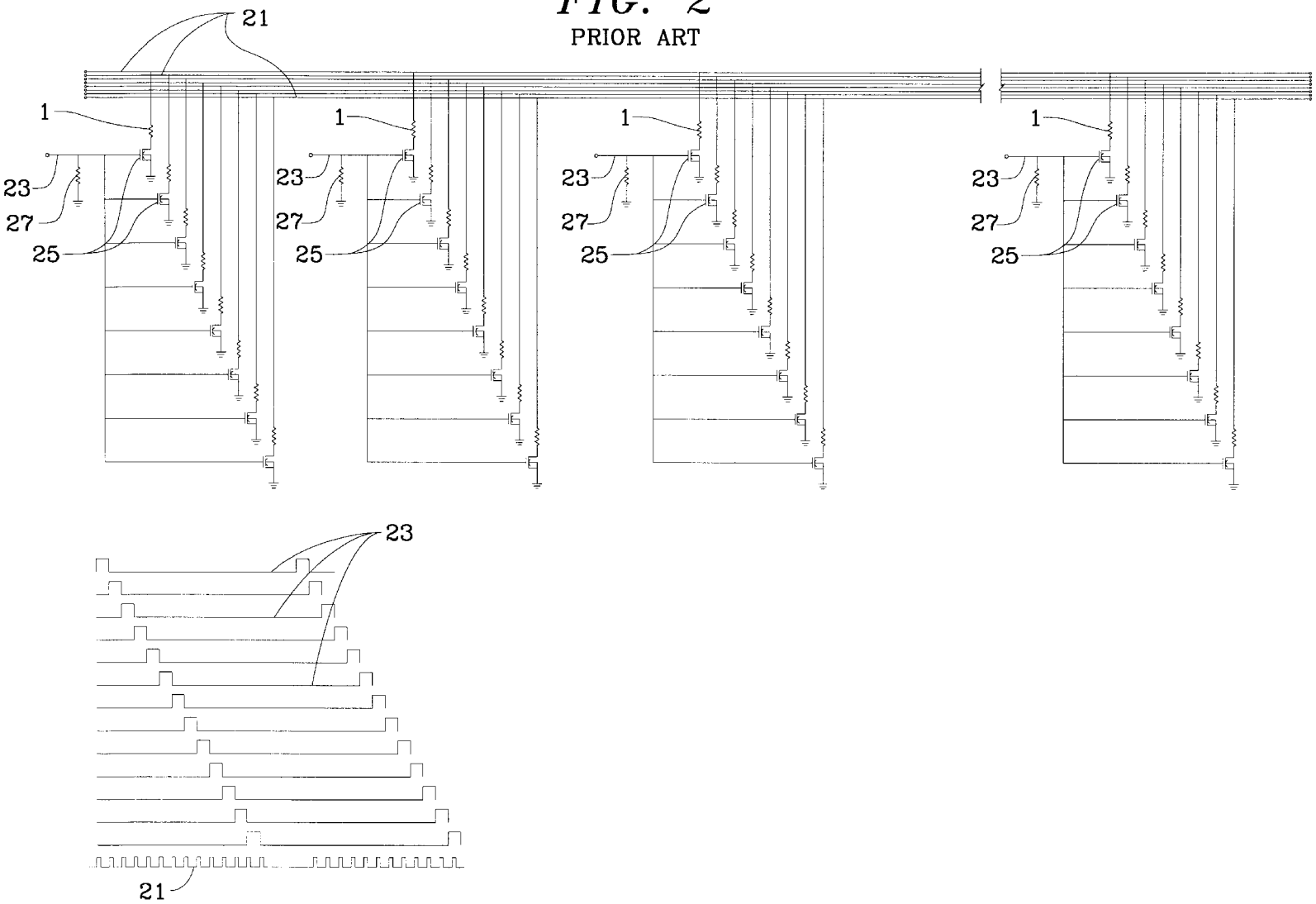
FIG. 2 PRIOR ART
FIG. 2 illustrates prior art multiplexing to achieve printheads with a larger number of heaters without an large number of electrical contacts.
Figures 3A, 3B:
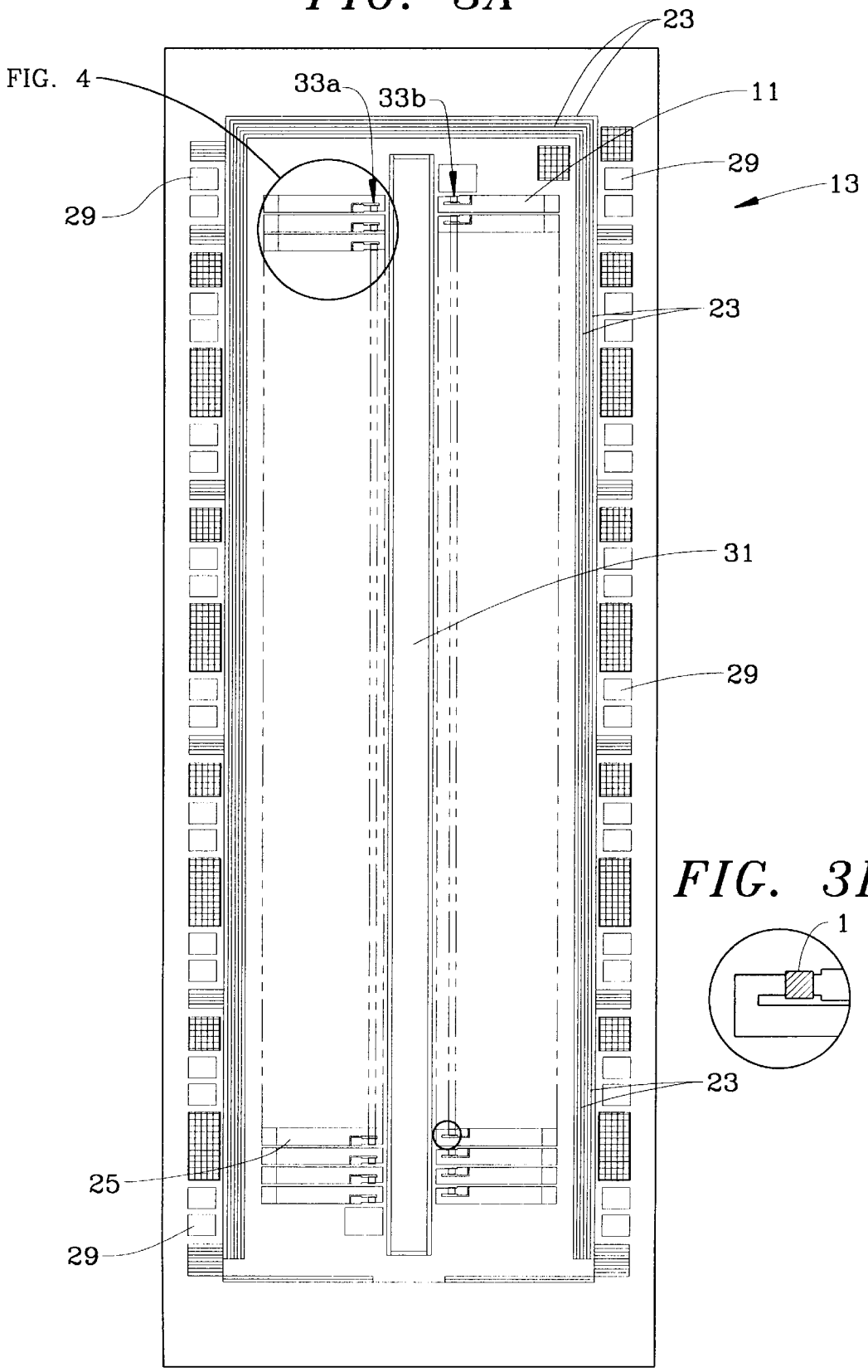
FIG. 3A is a top view illustrative of the chip of a printhead in accordance with this invention.
FIG. 3B is an enlargement of a heater portion corresponding to the lower circled portion in FIG. 1A.

FIG. 3A illustrates the semiconductor chip 13 made and populated in accordance with this invention. On each side of the long dimension of chip 13 are contacts 29, which are driven from signals from off the chip as is standard. The chip has an open channel 31 extending completely through the chip to receive liquid ink jet ink, from which the ink flows to chambers over each of the individual heaters 7 on the chip. Just inside contacts 29 are groups of address lines 23, which are connectors to the gates of channel MOSFET's 25. The heaters are in two columns 33*a* and 33*b*. FIG. 3B is an enlargement of a portion of column 33*b* showing a heater 1.

Figure 5:
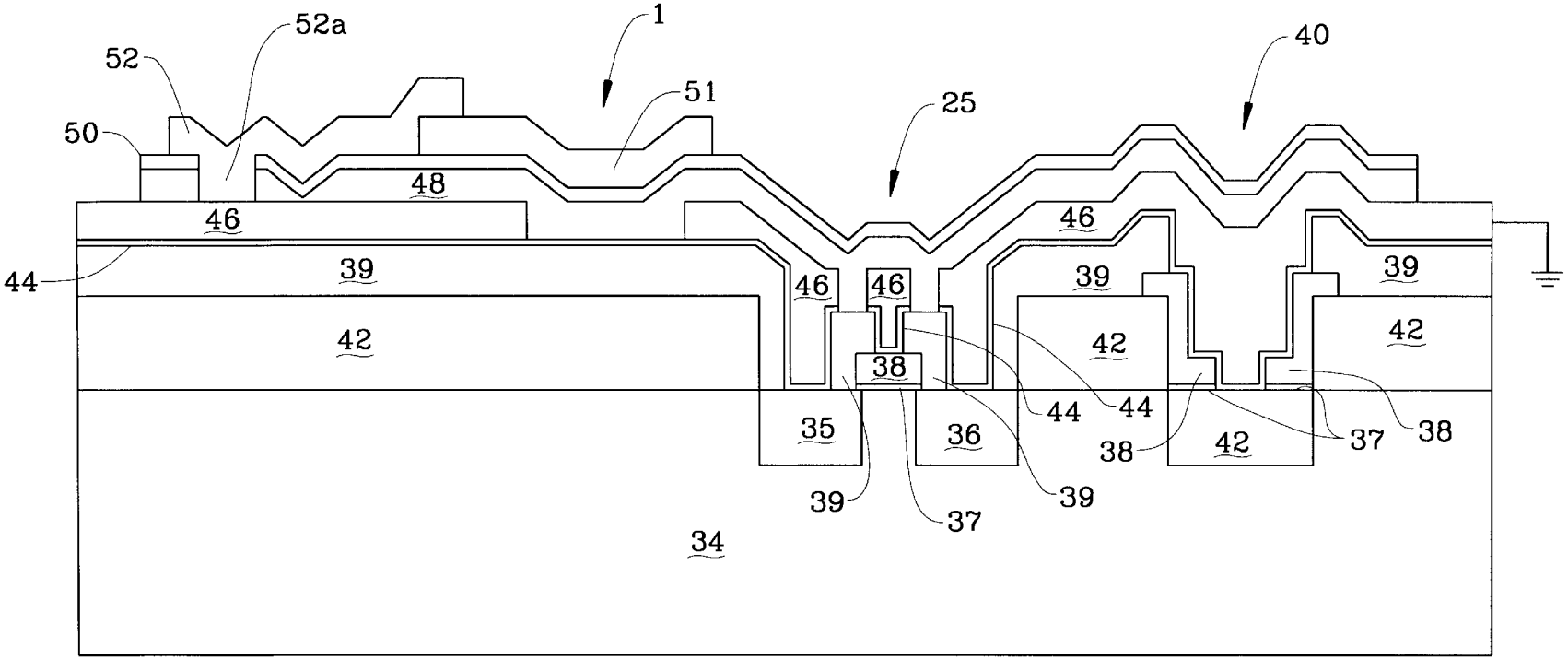
FIG. 5 is a composite section view along the sections shown in FIG. 4 showing the configuration of this invention.

FIG. 5 illustrates a section of chip 13 revealing the MOSFET 25 and the heater 1 in actual detail. The body of chip 13 is P Type silicon substrate 34. MOSFET 25 has an N+ doped drain 35 and N+ doped source 36, having a oxide gate layer 37 between substrate 34 and a conductive polysilicon region 38 which forms the gate contact. Above polysilicon 38 is field region 39 of boron-phosphorus doped silicate glass (BPSG).

Figure 4:
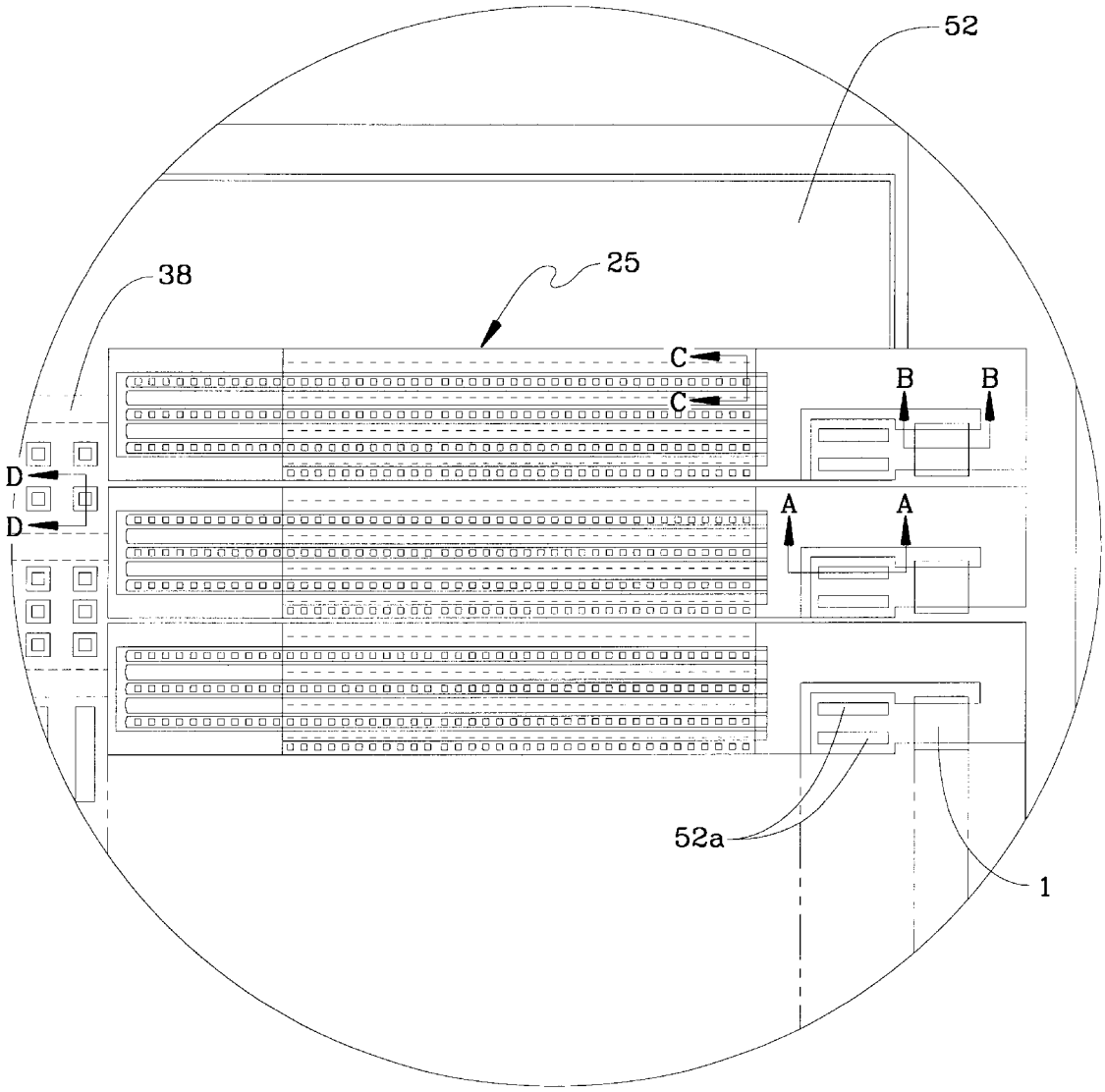
FIG. 4 is an enlargement of the transistor portion of the chip.

FIG. 4 shows by section lines A—A, B—B, C—C and D—D the composite section illustrated in FIG. 5, with A—A on the left of FIG. 5, B—B next, C—C next after B—B and D—D on the right of FIG. 5. The subcontact 40 is located at the ground bus connection of the channel MOSFET 25. Subcontact 40 is an essentially standard element contacting each MOSFET 25 source side to the silicon substrate 34. As shown in FIG. 5 subcontact 40 has an N+ doped region 42 and a large area of polysilicon conductor 38 with an oxide gate layer 37.

Next above substrate 34 under each heater 1 is a silicon dioxide layer 42. Above the layer 42 is a layer of the BPSG 39. The combination of silicon dioxide layer 42 and BPSG layer 39 is to serve as a thermal barrier. Next above the layer 39 is the resistive material 44, which preferably is hafnium diboride or tantalum aluminum, most preferably hafnium diboride. Since materials are necessarily applied to the substrate 34 as coatings, for reasons of cost or commercial convenience, they may exist on the chip at locations where they are not needed. This is very clear for resistive material 44, since it has a conductive layer 46 of aluminum-copper alloy (AlCu) over it everywhere except directly under heater 1. Electric current to drive heater 1 is applied to layer 46 and will not appreciably conduct through resistive layer such as 44 except at heater 1 where it has no other electrical path except through resistive material 44. At the region of heater 1 the electric current in resistive layer 44 causes heating which nucleates ink to print a drop of ink.

Because the resistive material 44 has a high melting point, conductive layer 46 is stable when applied directly to material 44. Above conductive layer 46 is a standard silicon nitride protective layer 48 and above that layer is a smaller standard silicon carbide protective layer 50. Immediately at heater 1 as its top element is a layer of tantalum 51 which is a stress buffer to absorb impacts from the bubble collapse from heater 1 during use, as is known in the prior art.

Finally, an outer conductive layer 52 at selected locations passes through a via 52*a* in layers 50 and 48 to connect with conductive layer 46. Layer 52 is also AlCu.

The essential novelty of this invention is the use the BPSG as a thermal barrier under the heater 1. Other elements as described above are made by standard techniques of the chip fabrication art. Specific thicknesses of the foregoing structure near heater 1 are as follows: upper metal 52, 10,500A; tantalum stress barrier 51, 6000A; silicon carbide protective layer 50, 2600A; silicon nitride protective layer 48, 4400A; buried AlCu conductive layer 46, 5200A, BPSG thermal barrier layer 39, 0.825 micron; $SiO_2$ thermal barrier layer 42, 0.825 micron.

The ink jet printhead 7 of which chip 13 forms a part in accordance with this invention is shown in FIG. 6 and FIG. 7. The printhead 7 includes a lid 52 and an upper ventilator 54 received beneath the lid 52 on the top of the printhead body 56. These components, 52, 54, and 56, are of molded plastic, the material being a polyphenylene oxide, Noryl SE-1 of GE Plastics. The material selected must be moisture resistant and chemically compatible with the components of the ink to be held in the printhead body.

The internal cavity of the printhead body contains a foam block 58 to meter the ink to the printhead heaters 1. The foam blocks are a reticulated polyether-polyurethane foam, a product of Foamex Corp. Printhead body 56 internally contains a conduit (not shown) to the central cavity 31 of chip 13 and a filter (not shown) to keep particles from the nozzles.

A tape automatic bonding (commonly TAB) circuit 60 is secured with heat and pressure to a side 62 of the print head body 56 as a means to make electrical connections to a chip 13, which is located in on the bottom of the printhead body 56 (FIG. 7). Attached to the outside of chip 13 is a nozzle plate 66, which has one nozzle hole for each heater 1. As is conventional, between nozzle plate 66 and chip 13 is a resin pattern (not shown, hidden by nozzle plate 66) made by photolithography and defining chambers over each heater 1 leading to one nozzle of nozzle plate 66.

In operation, a printer delivers electrical signal to TAB 60 which applies signals to the contacts 29 of chip 13 to selectively drive heaters 1 and produce printing dots through the nozzles of nozzle plate 66.

Alternatives employing BPSG as a barrier in a heater chip will be readily apparent and can be anticipated. Accordingly, patent coverage is sought as provided by law, with particular reference to the accompanying claims.

What is claimed is:

1. A thermal ink jet cartridge to contain ink for ink jet printing by nucleation by heat from heater elements of a silicon semiconductor chip, said chip comprising a plurality of resistors for carrying current to produce said heat to cause nucleation, a plurality of field effect transistors (FET's), a different one of said FET's being connected to each one of said resistors to control said current to said resistor to which said FET is connected, a layer of boron-phosphorus doped silicate glass (BPSG) immediately under said plurality of resistors, and a layer of silicon containing thermal insulator immediately under said layer of BPSG.

2. The thermal ink jet cartridge of claim 1 in which said BPSG layer is about 0.825 micron thick.

3. The thermal ink jet cartridge as in claim 2 in which said layer of silicon containing thermal insulator is $SiO_2$ about 0.825 micron thick.

4. The thermal ink jet cartridge as in claim 1 in which said layer of silicon containing insulator is $SiO_2$.

5. A thermal semiconductor chip having a substrate of P type silicon, a plurality of channel metal oxide semiconductor field effect transistors (MOSFET's), the field oxide of said MOSFET's being boron-phosphorus doped silicate glass (BPSG), a resistive layer of resistive hafnium diboride or tantalum aluminum, a conductive layer contacting said resistive layer except at heater locations at which current from said conductive layer will pass primarily through said resistive layer to cause heating under control of a different one of said MOSFET's for a different one of said heater locations, and a thermal barrier layer of BPSG immediately under each of said heater locations.

6. The semiconductor chip as in claim 5 also comprising a silicon containing thermal insulator layer immediately under said BPSG layer and immediately over said substrate.

7. The semiconductor chip of claim 6 in which said BPSG layer is about 0.825 micron thick.

8. The semiconductor chip of claim 7 in which said layer of $SiO_2$ is about 0.825 micron thick.

9. The semiconductor chip of claim 6 in which said layer of silicon containing thermal insulator is $SiO_2$.

10. The semiconductor chip of claim 5 in which said BPSG layer is about 0.825 micron thick.

* * * * *